US010159987B2

(12) United States Patent
Malfait et al.

(10) Patent No.: US 10,159,987 B2
(45) Date of Patent: Dec. 25, 2018

(54) SHREDDER COMPRISING ONE OR MORE NOZZLE ASSEMBLIES

(71) Applicant: JET-ZONE BVBA, Zwevegem (BE)

(72) Inventors: Nicolas Aurele Luc Malfait, Izegem (BE); Mirko Savic, Lauwe (BE)

(73) Assignee: JET-ZONE BVBA, Zwevegem (BE)

( * ) Notice: Subject to any disclaimer, the term of this patent is extended or adjusted under 35 U.S.C. 154(b) by 972 days.

(21) Appl. No.: 14/405,508

(22) PCT Filed: Jul. 17, 2013

(86) PCT No.: PCT/EP2013/065127
§ 371 (c)(1),
(2) Date: Dec. 4, 2014

(87) PCT Pub. No.: WO2014/012993
PCT Pub. Date: Jan. 23, 2014

(65) Prior Publication Data

US 2015/0122919 A1 May 7, 2015

(30) Foreign Application Priority Data

Jul. 18, 2012 (BE) ..... 2012/0501

(51) Int. Cl.

| | |
|---|---|
| ***B02C 23/24*** | (2006.01) |
| ***B05B 15/65*** | (2018.01) |
| ***B05B 15/14*** | (2018.01) |
| ***B05B 15/70*** | (2018.01) |
| ***B05B 15/62*** | (2018.01) |

(52) U.S. Cl.
CPC ..... *B02C 23/24* (2013.01); *B05B 15/14* (2018.02); *B05B 15/65* (2018.02); *B05B 15/70* (2018.02); *B05B 15/62* (2018.02)

(58) Field of Classification Search
CPC ..... B02C 23/24; B02C 23/30; B02C 23/18; B01F 15/063; B05B 15/10; B05B 15/065; B05B 15/061
USPC ..... 241/18, 189.1, 188.1, 73, 41, 39; 239/541, 289
See application file for complete search history.

(56) References Cited

U.S. PATENT DOCUMENTS 2,896,861 A 7/1959 Hruby
3,977,609 A * 8/1976 Gallant ..... B05B 15/5225 239/417.3

(Continued)

FOREIGN PATENT DOCUMENTS

DE 4036347 A1 5/1992
DE 4235359 C1 10/1993

(Continued)

OTHER PUBLICATIONS

International Search Report for corresponding International PCT Application No. PCT/EP2013/065127, dated Nov. 13, 2013.

*Primary Examiner* — Jessica Cahill
*Assistant Examiner* — Smith O Bapthelus
(74) *Attorney, Agent, or Firm* — Workman Nydegger

(57) ABSTRACT

A shredder comprises one or more nozzle assemblies each including an elastic element configured to work in conjunction with the nozzle and the nozzle housing such that the nozzle is held in the home position when in an unloaded rest condition and as a result of an impact temporarily moves in the direction of the impact position.

16 Claims, 8 Drawing Sheets

(56) References Cited

U.S. PATENT DOCUMENTS

| | | | | | |
|---|---|---|---|---|---|
| 4,205,799 | A * | 6/1980 | Brewer | B02C 18/0084 | 241/243 |
| 4,585,173 | A | 4/1986 | Soule | | |
| 5,215,254 | A * | 6/1993 | Haruch | B05B 15/02 | 239/107 |
| 5,364,252 | A * | 11/1994 | Hlavaty | B29C 45/1734 | 264/328.12 |
| 5,405,088 | A * | 4/1995 | Gordon | F02M 61/045 | 239/453 |
| 5,454,869 | A | 10/1995 | Roden | | |
| 5,556,039 | A * | 9/1996 | Minamimura | B02C 18/142 | 241/158 |
| 6,050,457 | A * | 4/2000 | Arnold | B05B 11/3016 | 222/321.1 |
| 7,013,526 | B2 * | 3/2006 | Eskelinen | B05C 11/026 | 100/174 |
| 7,540,235 | B2 * | 6/2009 | Schwelling | B02C 18/142 | 100/174 |

FOREIGN PATENT DOCUMENTS

| | | |
|---|---|---|
| EP | 0302668 A2 | 2/1989 |
| EP | 0336011 A1 | 10/1989 |

* cited by examiner

SHREDDER COMPRISING ONE OR MORE NOZZLE ASSEMBLIES

BACKGROUND

The invention regards a shredder comprising a nozzle assembly for atomising a liquid for preventing dust formation. Furthermore, the atomisation of a liquid can also be useful in controlling the temperature within the shredder housing or for achieving a specific humidity that reduces the risk of explosions.

A nozzle assembly for use in a shredder for atomising a liquid for preventing dust formation is known for example from DE 4235359. The atomisation of liquid in that case however, takes place in the input zone and output zone of the shredder installation and not in the shredder itself where the dust forms. The dust-capturing is hereby less efficient. Moreover in such a configuration, the humidity level of the material that is fed-in and discharged increases, whereby subsequent sorting processes are less efficient because the material particles stick to each other.

DE 4036347 describes a nozzle that is mounted in the cutting drum itself. Although in this configuration the nozzles are mounted in the shredder itself, the nozzles are susceptible to wear and blockages. They are in a position that is difficult to reach and this is disadvantageous when they require replacement. Above all, this system uses the shredder dent to achieve atomisation. When this shredder dent is worn or if the shredder dent is contacting the material to be threshed then this prevents the efficient atomisation of the liquid. Finally, such a construction requires substantial modifications to the cutting drum and thus cannot easily be applied in existing installations.

Consequently, there is a need for a shredder with a nozzle assembly with a longer lifespan and a reduced risk of damage and blockages that moreover, can be easily installed in existing shredder installations. Also, it should be prevented that the humidity levels of the materials processed by the shredder increase excessively.

SUMMARY

According to a first aspect of the invention there is provided a shredder comprising a cutting drum and a shredder housing, the shredder housing comprising one or more nozzle assemblies mounted in a working zone of the cutting drum, the one or more nozzle assemblies each configured to atomise a liquid in the working zone of the cutting drum and each comprising:

- A nozzle with an intake orifice configured to receive the liquid, and a discharge orifice configured to atomise the liquid; and
- A nozzle housing in which the nozzle is mounted, the nozzle housing comprises an inlet opening on the side of the intake orifice and an outlet opening on the side of the discharge orifice,

CHARACTERISED IN THAT

The nozzle is mounted moveably in the nozzle housing such that the nozzle is moveable between an impact position and a home position, The nozzle assembly further comprises an elastic element mounted to work in conjunction with the nozzle and the nozzle housing such that the nozzle:

- is held in the home position in an unloaded rest condition in which the nozzle is not subjected to an impact; and
- as a result of the force of an impact temporarily moves in the direction of the impact position Hereby, the atomised liquid can be applied to the zone where the dust forms with a limited impact to the humidity level of the material to be processed. Additionally the moveable positioning of the nozzle and the dampening effect of the elastic element greatly increases the lifespan of the nozzle, in particular when it is mounted in the shredder itself, as the risk of damage during an impact is reduced. Tests have shown that a nozzle in accordance with the invention had a lifespan of 6 to 8 weeks, while the lifespan of the same nozzle without the elastic element was less than 1 hour. Additionally, the movement of the nozzle during an impact causes a self-cleaning effect whereby the risk of blockage is reduced.

According to an embodiment the home position:

- is positioned closer to the cutting drum than the impact position, and
- is positioned such that the nozzle at the side of the discharge orifice does not protrude from the shredder housing when positioned in the home position.

This way of positioning the nozzle allows for a reduced risk of impact during operation of the shredder at the most sensitive part of the nozzle for its efficient operation, namely at the discharge orifice.

According to an embodiment, the nozzle housing comprises a first stop against which the nozzle is pressed by the elastic element is pressed in order to hold the nozzle in the home position.

According to a further embodiment, the nozzle housing comprises a second stop against which the nozzle is pressed in the impact position as a result of the force of an impact.

This enables the nozzle assembly to be easily manufactured.

It is preferable that the nozzle assembly comprises non-magnetic materials.

This is particularly advantageous when the shredder is a component of an installation in which magnetic materials have also been incorporated. The risk that magnetic particles will block the nozzle is hereby reduced.

Optionally, the liquid that is to be atomised is combined with a gas, for example a compressed gas, such as for example compressed air.

This means that suitable atomisation can be achieved at a lower fluid pressure.

According to an optional configuration, the elastic element comprises a spring, an elastic bushing and hydraulic circuit with an accumulator, a pneumatic circuit and/or two magnets with opposing magnetic fields.

It is preferable that the nozzle housing is produced as a mounting element for the shredder.

This enables the nozzle assembly to be easily installed in a shredder.

According to an embodiment, the shredder housing is lined with one or more wear plates and the one or more of the nozzle assemblies are mounted in replacements of a mounting element for one or more of these wear plates.

This enables the nozzle assemblies to be easily installed in existing shredders in an easily accessible position. Moreover, a replacement procedure can be performed in the same way as a replacement procedure for the wear plates.

According to a preferred embodiment the discharge orifice is configured to atomise the liquid with a droplet size of less than 2 mm, preferably less than 1 mm, for example 10 μm-300 μm.

Such a droplet size allows for an efficient capture of dust particles and/or cooling down in the work zone of the cutter drum of the shredder.

According to a second aspect of the invention there, is provided a method of operating a shredder according to the first aspect of the invention, characterised in that the nozzle assemblies undergo a rinsing cycle after completing an active labour cycle, and in that the nozzle assemblies (10) are rinsed with a fluid without additives during the rinsing cycle.

This further reduces the risk of blockage in the nozzle as any additives are flushed from the area of the discharge orifice and any debris at the height of the discharge orifice is flushed away before a period of inactivity of the shredder.

Optionally, the flow rate of the liquid is determined in relation to the load on the shredder.

In this way, the efficient dust-capturing operation can be guaranteed with a minimal impact on the humidity levels of the material to be processed.

BRIEF DESCRIPTION OF THE DRAWINGS

The invention will now further be described with reference to the drawings wherein.

DETAILED DESCRIPTION OF VARIOUS EMBODIMENTS

Figure 1:
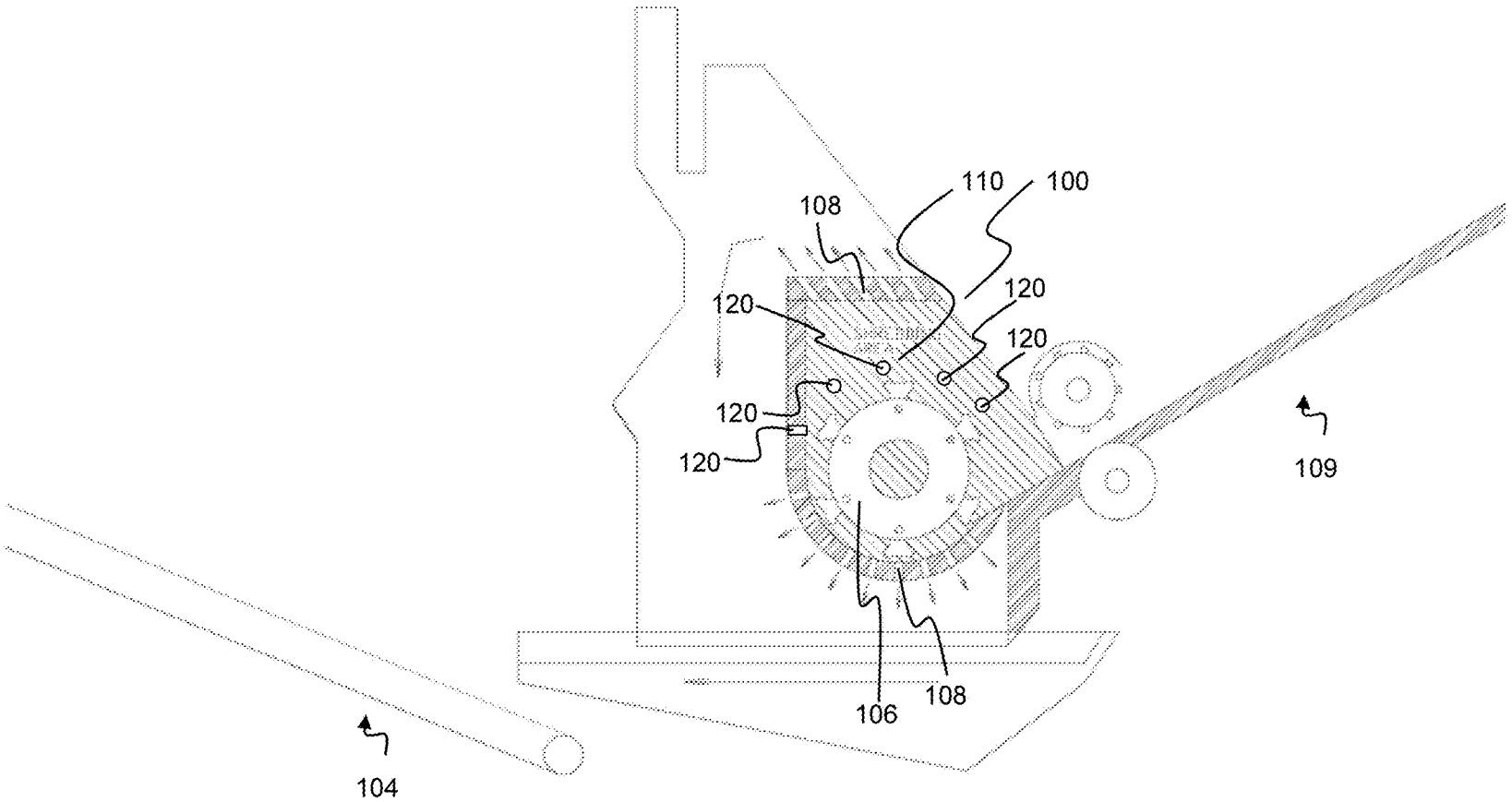
FIG. 1 schematically illustrates a shredder installation.

FIG. 1 illustrates a schematic example of a shredder installation. Such a shredder installation is deployed, for example, for recycling vehicles, for processing scrap, debris, paper, textile, stones, . . . or other activities whereby materials are broken up into tiny parts, granulated, grinded, etc, such that they can be processed or sorted later on for example. It is clear that alternative embodiments to that of FIG. 1 of such a shredder or thresher are available. The shredder of FIG. 1 comprises a generally horizontally arranged cutting drum 106, however according to alternative embodiments the shredder could make use of other arrangements of the cutting drum, for example a generally vertical arrangement. Alternative embodiments could make use of alternative elements instead of a cutting drum, such as for example grinding discs, or other suitable elements that could have any suitable speed of rotation. A lot of different types of shredder installations are known wherein the nozzle assembly 10 according to the present invention can be mounted. As illustrated in FIG. 1, the material is fed-in to the shredder 100 by way of an input unit 109 that, for example, comprises a belt and feed rollers. This shredder 100 comprises a cutting drum 106 that is mounted in the shredder housing 120. The cutting drum 106 is rotated round a, generally horizontal, central rotary axis by means of a drive and comprises hammers, knives or other suitable elements to break up the fed-in materials into smaller parts. Openings 108 are provided in the shredder housing 120 through which the broken materials can escape to an outlet unit 104 which discharges the broken materials for further processing. Inside the shredder housing 120, namely at the height of the cutting drum 106, the working zone 110 is located where the dust that is generated during this operation forms. The shredder housing 120 is often provided on the inside, namely the side facing the cutting drum 106, with wear plates 122 that can be replaced when the wear caused by the impact of material that is broken or catapulted by the cutting drum 106 have reached certain levels. These wear plates 122 are for example, secured to the shredder housing 120 by way of mounting components, such as removably mounted bolts. As further shown in FIG. 1, a number of nozzle assemblies 10 are mounted in this working zone 110 such that the atomisation of a liquid, or optionally a fluid combined with a gas such as a compressed gas like compressed air, will efficiently prevent the dust formation as well as controlling the temperature or achieving a certain air humidity that reduces the risk of explosions.

Figure 2A:
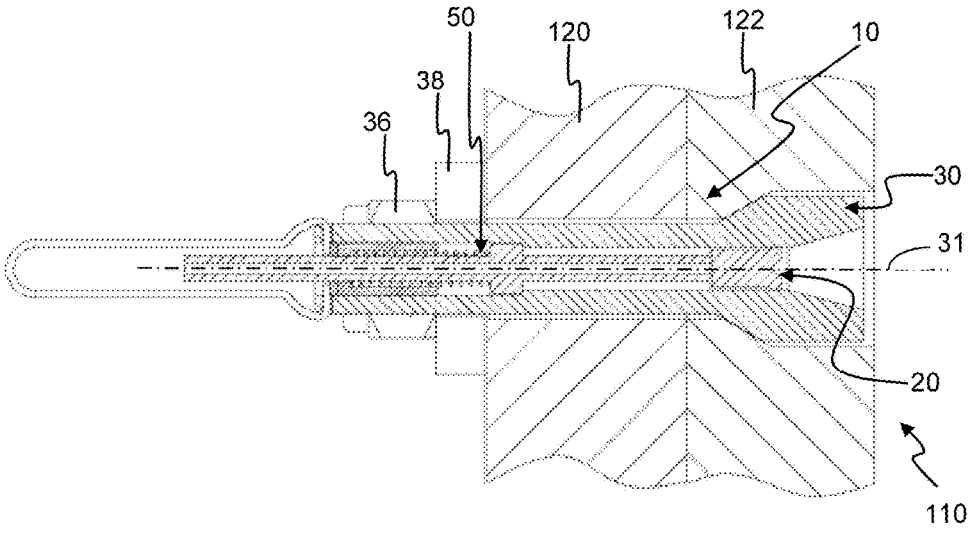
FIG. 2A-C illustrates a cross-section of an embodiment of a nozzle assembly according to the invention.
Figure 2B:
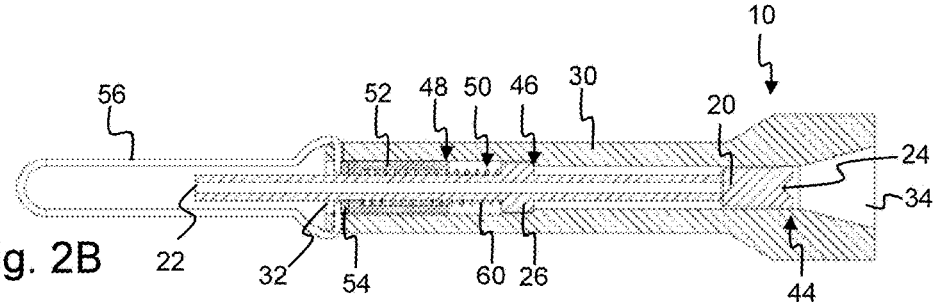
Figure 2C:
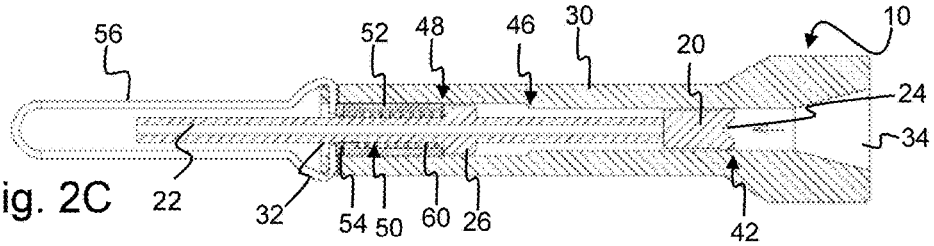

An embodiment of a nozzle assembly 10 for the atomisation of a liquid to prevent dust formation in the working zone 110 of a shredder 100 is illustrated in FIGS. 2A, 2B and 2C. The nozzle assembly 10 generally comprises a nozzle 20, nozzle housing 30 and an elastic element 50.

The nozzle housing 30 of the embodiment illustrated in FIGS. 2A-C is produced as a bolt 30 with which the wear plate 122 is attached to the shredder housing 120. The bolt 30 is attached by way of a suitable nut 36 and a washer 38. It is clear that alternative mounting elements 30 for the shredder 100 can form the nozzle housing 30 for the nozzle assembly 10, such as for example a bushing or a threaded insert or screw thread in the wear plate 122 or the shredder housing 120. According to another variant it is possible that the nozzle housing 30 of the nozzle assembly 10 is formed by the shredder housing 120 and/or the wear plates 122. The advantage of the embodiment illustrated in FIGS. 2A-C whereby the nozzle housing 30 is produced as a mounting element 30 for the wear plates 122 is that in this way, the nozzle assembly 10 can be mounted in the working zone 110 of the cutting drum 106 of the shredder 100. Moreover in this embodiment the nozzle assembly 10 can be easily mounted, even in an existing shredder 100, as a replacement mounting element for the wear plates 122. The nozzle housing 30 comprises a central boring in alignment with the longitudinal axis 31 of the bolt 30. The nozzle 20 is mounted herein, as shown in FIGS. 2A-C.

This nozzle 20 comprises an intake orifice 22 for feeding the liquid, or optionally the fluid combined with gasses, for example a compressed gas such as compressed air, on the one side and on the opposite side it has a discharge orifice 24 configured for atomising the liquid. The nozzle 20 is formed as a nozzle 20 that is capable of atomising the liquid such that it achieves optimal binding with the dust generated in the shredder housing 120. In such applications, the nozzle 20 generally generates a vapour with a droplet size of less than 2 mm, preferably less than 1 mm, for example 10 μm-100 μm or 10 μm-300 μm, for example 10 μm, 20 μm, 50 μm, 100 μm 250 μm. Optionally to achieve optimal atomisation, the discharge opening 24 can comprise an internal vortex or other suitable form that facilitates the atomisation of the liquid. To this end, the nozzle housing 30 comprises an inlet opening 32 on the side of the intake orifice 22 and an outlet opening 34 on the side of the discharge orifice 24. The outlet opening 34 is formed in such a way that it does not obstruct the outflow of the atomised liquid. As is shown in FIGS. 2A-C, the outlet opening 34 extends further towards the working zone 110 than the discharge orifice 24 of the nozzle 20. This is to protect the nozzle 20 against the impact of materials in the working zone 110. However, the form of the outlet 34 can preferably be chosen such that it offers sufficient resistance against blockages. As is shown in the embodiment, the outlet 34 is provided with a slightly conical from that opens in the direction of the working zone 110 to achieve this.

The nozzle 20 is moveably mounted in the nozzle housing 30. The nozzle 20 can move in alignment with the longitudinal axis 31 between an impact position 42, illustrated in FIG. 2C, and a home position 44, illustrated in FIG. 2B. To this end, the nozzle assembly 10 comprises an elastic element 50 that is mounted to work in conjunction with the nozzle 20 and the nozzle housing 30 such that the nozzle 20 is held in a home position 44 in an unloaded rest condition in which the nozzle is not subjected to an impact. The elastic element 50, according to the embodiment illustrated in FIGS. 2A-C, is a spring 60 that is produced as a helical compression spring 60. When constructing the nozzle assembly 10 the nozzle 20 is inserted via the inlet opening 32 in the nozzle housing 30. The boring that forms the inlet opening orifice 32 has a slightly larger diameter than the boring connected to the outlet 34 of the nozzle housing 30. This forms a first stop 46 that works in conjunction with an annular protrusion 26 on the nozzle 20 in order to limit how far that the nozzle 20 can move in the direction of the outlet 34 of the nozzle housing, this position corresponds to the home position 44. Thereafter, the spring 60 is mounted on the nozzle 20 in the boring on the inlet opening 32 in the nozzle housing 30. The annular protrusion 26 forms in this way, as illustrated, a seat for the end of the spring 60. Subsequently, a bushing 52 is slid over the spring 60 and the nozzle 20 in the boring in the inlet opening 32 in the nozzle housing 30. In this way, this bushing 52 forms a seat for the other side of the spring 60. Thereafter, this bushing 52 is secured, preferably by way of a washer 54 and a spring clip 56, in the boring on the inlet opening 32 in the nozzle housing 30. The distance between both seats for the spring 60 is chosen in such a way that in the home position 44, illustrated in FIG. 2B, the spring 60 has already been compressed and as such exerts a certain resistance whereby the nozzle 20 is pressed against the first stop 46 in an unloaded rest condition and as such is held in the home position 44.

As is shown in FIG. 2C, the elastic element 50 in the form of a spring 60 means that as a result of the force or load of an impact the nozzle 20 temporarily moves in the direction of the impact position 42. An impact as a result of material particles that are thrown around by the cutting drum 106 in the shredder zone 110 causes a force on the side of the outlet orifice 24 of the nozzle 20. The component of this force, in alignment with the longitudinal direction 31, will push the nozzle 20 in the direction of the outlet 34 of the nozzle housing 30. This causes the annular protrusion 26 to affect the spring 60 and to compress it until the annular protrusion reaches the bushing 52 that then in this way, forms the second stop 48 for the nozzle 20 that determines the maximum displacement of the nozzle 20 in the direction of the outlet orifice 34, namely the impact position 42 as illustrated in FIG. 2C. The force that develops from the material particles during an impact is naturally of short duration and as a result, the spring 60 will ensure that as soon as this force is reduced the nozzle moves back into the home position 44, as illustrated in FIG. 2B. Hereby, the nozzle 20, on the side of the discharge orifice 24, moves forward in the boring of the outlet orifice 34 of the nozzle housing 30 which causes a self-cleaning effect and reduces the risks of blockages in the nozzle assembly 10. This means that the material particles or dust that have accumulated in the boring in the nozzle housing 30 during an impact at the level of the outlet orifice 34 are pushed out by the nozzle 20, that moves in the direction of the outlet orifice 34, on the one hand by the force of the fluid jet exiting the nozzle 20 at the discharge orifice 24, and on the other hand, as illustrated in FIGS. 2A-C, by the nozzle 20 that is closely aligned with the boring in the nozzle housing 30 at the level of the discharge orifice 24 such that in this way, the nozzle 24 material remnants or dust can be pushed to the outlet 34.

Although the spring 60 in FIG. 2A-C is produced as a compression spring it is clear that according to variant embodiments other types of springs can be used, for example: extension springs, disk springs, torsion springs, and elastics. It is further also clear that according to the embodiment shown in FIGS. 2A-C the home position 44 is preferably positioned closer to the cutting drum 106 than the impact position 42, this means closer to the inside of the thresher. As further shown, preferably the home position 44 is positioned such that the nozzle 20, at the side of the discharge orifice 24, does not protrude or project from the shredder housing 120 when positioned in the home position 44. This means that the nozzle 20 does not protrude or project from the shredder housing 20 into the inside of the shredder 100, thus reducing the risk of damage to the most sensitive part for the efficient operation of the nozzle 20, namely the discharge orifice 24. Additionally it is clear from FIGS. 2A-C the nozzle assembly 10 is arranged in an opening through the shredder housing with the discharge orifice 24 positioned at the inside of the shredder 100 and the intake orifice 22 at the outside of the shredder 100.

The various components of the nozzle assembly 10 are preferably manufactured from non-magnetic materials and/or wearproof materials. This to prevent that, when processing magnetic materials, the magnetic particles attach themselves, in particular at the level of the outlet opening 34 which could cause blockages there. This situation can occur for example, during vehicle recycling whereby magnets are present in the speakers of the vehicle's sound installation. Suitable materials here are for example, Creusabro M or Inox steel.

Figure 3A:
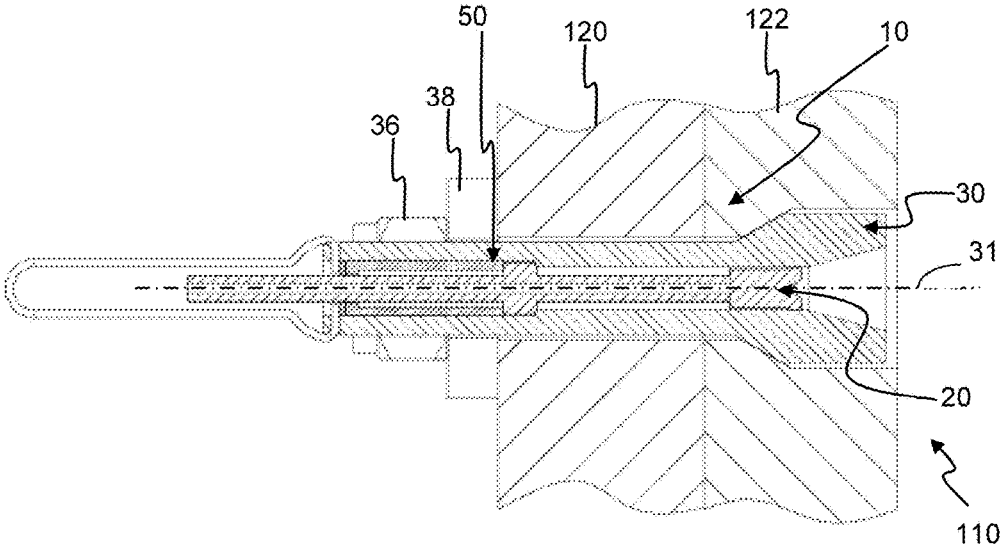
FIG. 3A-C-7A-C alternative embodiments of the nozzle assembly illustrated in FIG. 2A-C.
Figure 3B:
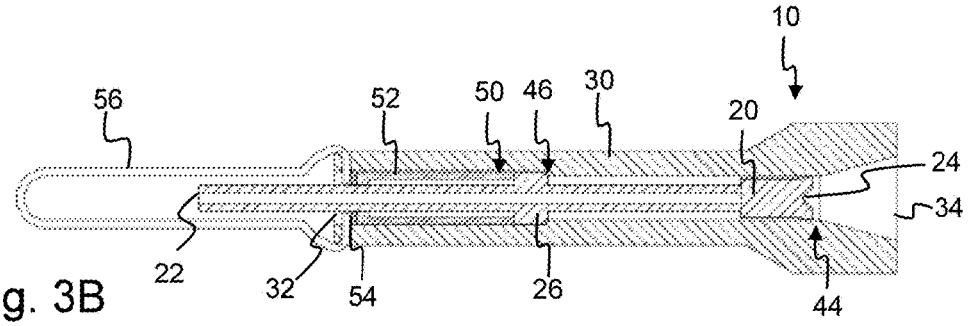
Figure 3C:
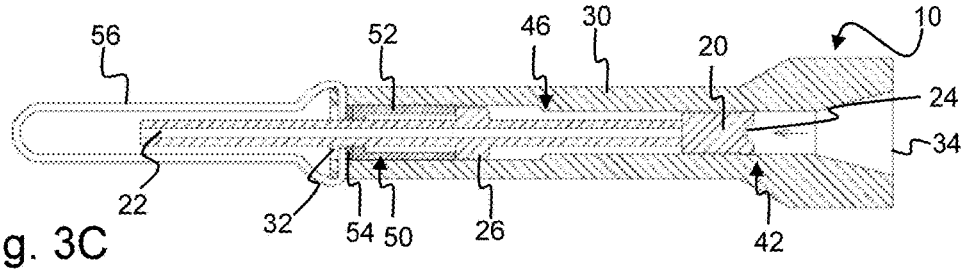

In FIGS. 3A-C an alternative embodiment is illustrated that is similar to the embodiment illustrated in FIGS. 2A-C. However, the spring 60 is no longer present. In this case the elastic element 50 is formed by the bushing 52 that is manufactured from a suitable elastic material, such as, for example a flexible synthetic material, such as soft rubber, foam rubber or polyurethane. According to another alternative, the bushing 52 can be formed by applying a suitable foam in the area where the bushing is mounted. Similar to the embodiment illustrated in FIGS. 2A-C, the elastic bushing 52 ensures that in the home position 44, illustrated in FIG. 3B, the annular protrusion 26 of the nozzle 20 is pressed against the first stop 46 of the nozzle housing 30. As is shown in FIG. 3C the elastic bushing 52 also allows the nozzle 20 to temporarily move to the impact position 42 when an impact occurs. As illustrated, this embodiment does not comprise a second stop defining this impact position 42. In this case, the impact position 42 is defined by the maximum compressibility of the elastic element 50 as a result of an impact of the material particles in the working zone 110 of the shredder 100.

Figure 4A:
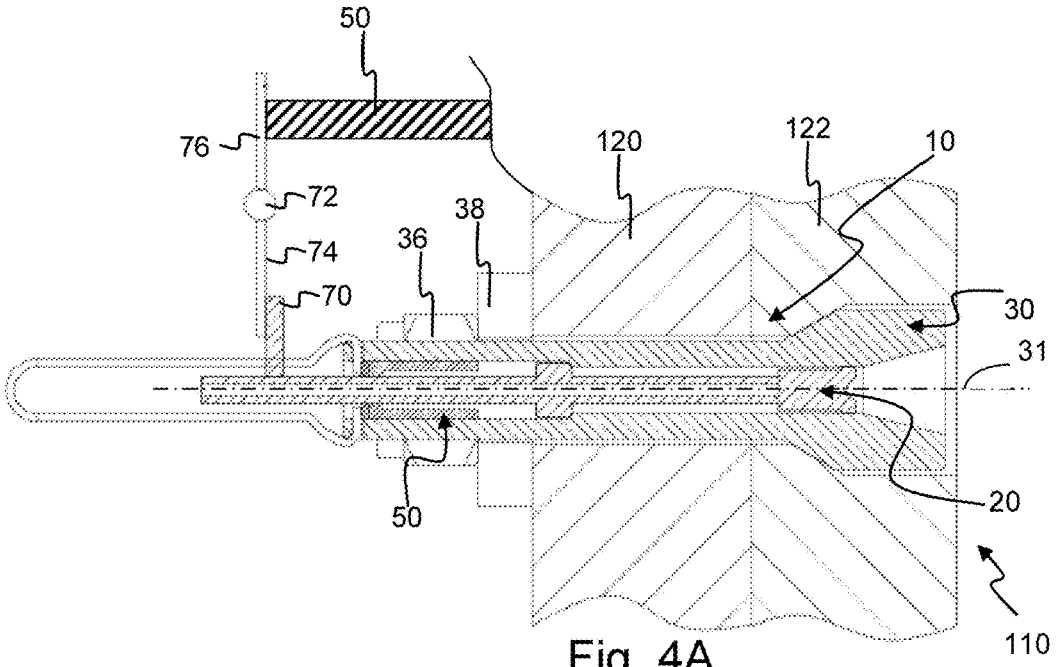
Figure 4B:
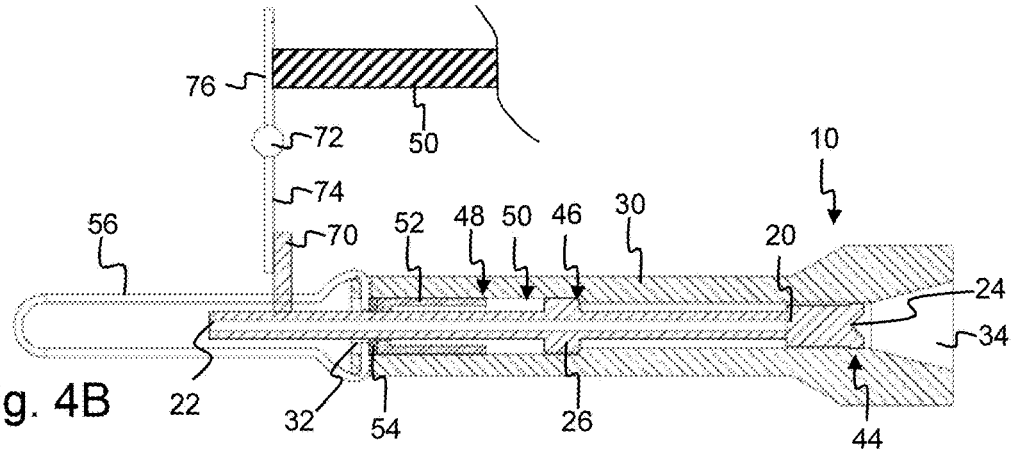
Figure 4C:
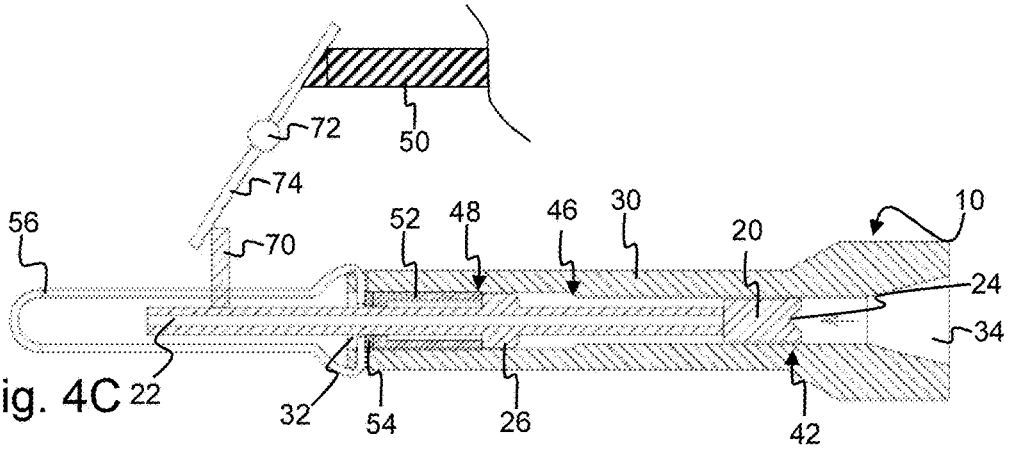

It is not required to install the elastic element 50 inside the nozzle housing 30. According to an alternative embodiment illustrated in FIGS. 4A-C, the elastic element is mounted outside the nozzle housing 30 and connected to the nozzle 20 by way of a lever system 72, 74, 76. As is schematically illustrated, an arm 70 is mounted on the nozzle that is in contact with a first arm 74 of the lever system. In this way, the movement of the nozzle 20 results in a rotation of the first arm 74 around the lever system's axis of rotation 72, which then results in a rotation of the second arm 76 of the lever system. This second arm 76 is connected to one side of the elastic element 50, for example a compression spring, that is connected at its other side to the shredder housing 120. It is clear that in this way, the elastic element 50 is also capable of pressing the nozzle 20 with the annular protrusion 26 against the first stop 46 of the nozzle housing 30 in unloaded rest condition and in this way hold it in the home position 44. It also ensures that as a result of an impact, the nozzle 20 temporarily moves to the second stop 48 in the direction of the impact position 42. Such an embodiment enables a simple control of the force developed by the elastic element 50 by for example, adjusting the coupling point on the lever system or the spring force of the elastic element 50 by for example, tensioning or relaxing it or by replacing it with an elastic element 50 with another spring force. It is clear that numerous alternative embodiments of the lever arms are possible. According to an alternative embodiment it is also possible to replace the lever mechanism with a system of pulleys. According to another alternative embodiment, the elastic element 50 can be produced as a weight that, under the influence of gravity, pushes one of the arms of the lever, or cable of the pulley system, downwards and is thus connected to the nozzle 20 such that it is then held in the home position 44, while, during an impact, the movement of the nozzle 20 will temporarily move the weight upwards.

Figure 5A:
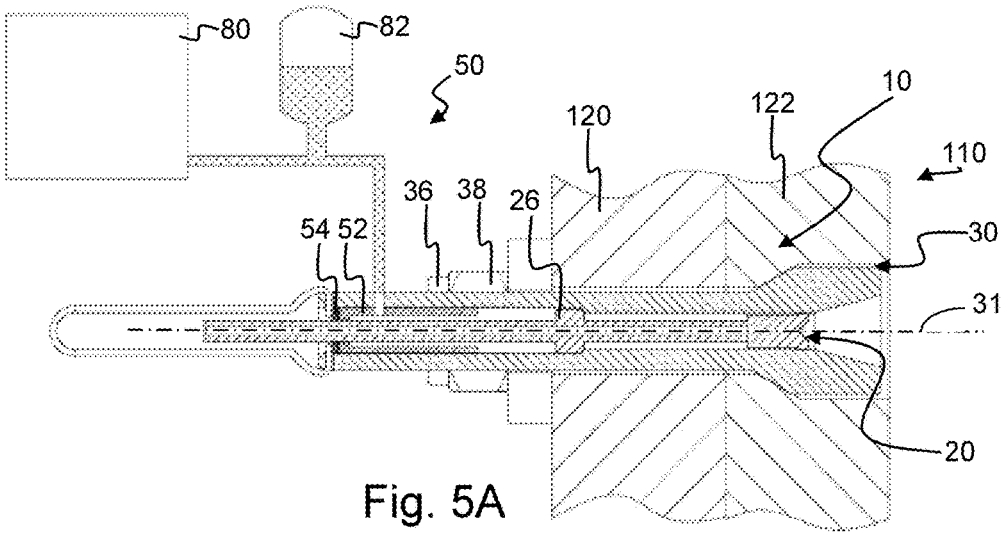
Figure 5B:
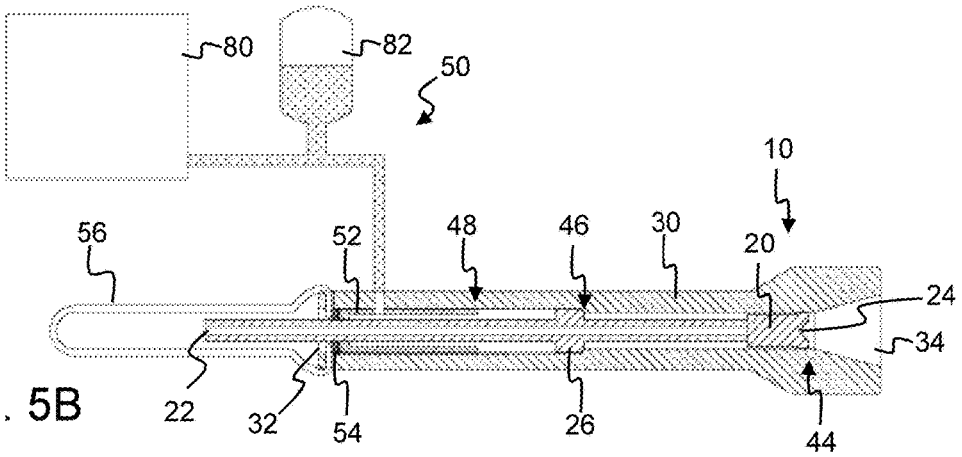
Figure 5C:
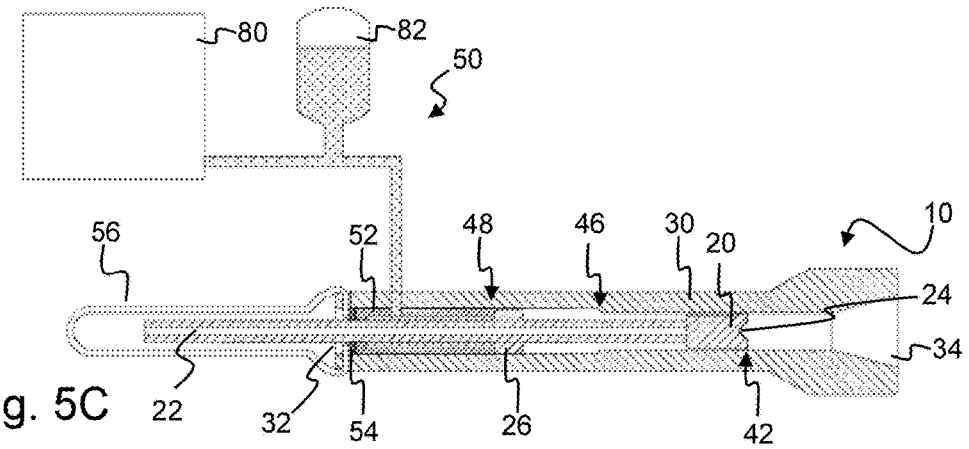

FIGS. 5A-C illustrates another alternative embodiment of the elastic element 50 for an embodiment of a nozzle assembly 10 similar to that which is illustrated in FIGS. 2A-2C. The function of the elastic element 50 however, is here achieved by a hydraulic circuit 80 with an accumulator 82. The hydraulic liquid in the accumulator 82 is connected via a hydraulics line to an opening in the nozzle housing 30 and the bushing 52 which provides access to a cavity in the inlet opening 32 of the nozzle housing 30 that is sealed on the one side by the bushing 52 and on the other side by the annular protrusion 26 of the nozzle 20. This cavity and the annular protrusion 26 can, as illustrated, function as moveable hydraulic pistons in this cavity. The pressure present in the hydraulic liquid in this cavity will, in the unloaded rest condition, hold the nozzle 20 with its annular protrusion against the first stop 48 in the home position as illustrated in FIG. 5B. During an impact as illustrated in FIG. 5C, the annular protrusion 26 of the nozzle 20 will temporarily move in the direction of the second stop 48 and thus send an amount of hydraulic liquid out of this cavity to the accumulator 82. When the force or load of the impact has disappeared, under the influence of the pressure present in the accumulator, this hydraulic liquid will be moved back to the cavity and thus move the annular protrusion 26 of the nozzle back to the first stop 46. It is not required that the circuit 80 continually activates the accumulator 82 to provide the hydraulic liquid to the accumulator 82 with a specific pressure. It is sufficient that the accumulator 82 is initially provided with the desired pressure after which it can be closed-off from the hydraulic circuit. The hydraulic liquid could, for example, be a suitable viscous liquid such as oil, glycerol or water.

Figure 6A:
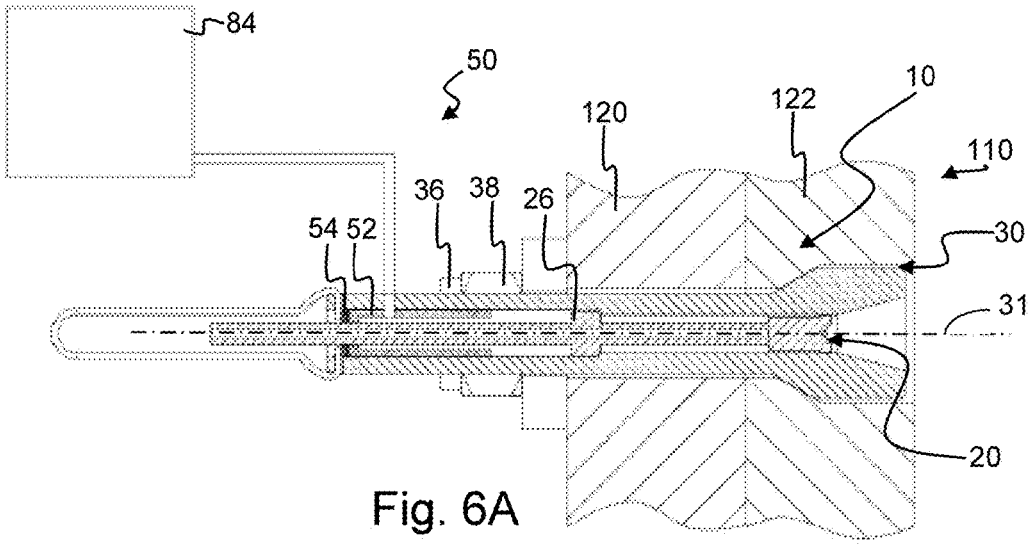
Figure 6B:
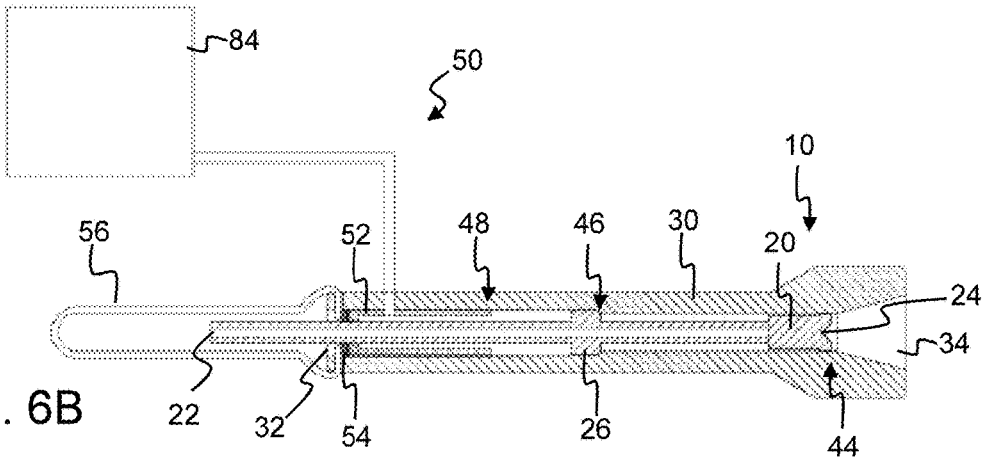
Figure 6C:
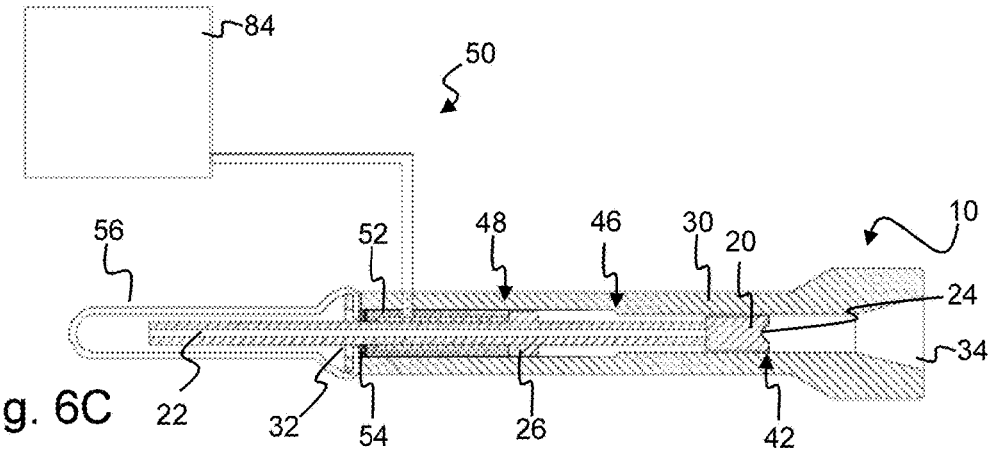

FIGS. 6A-C shows an alternative embodiment similar to the embodiment in FIGS. 5A-C. The elastic element 50 in this case however, is achieved using a pneumatic circuit 84 that is connected via a pneumatic line to an opening in the nozzle housing 30 and the bushing 52 that provides access to a cavity at the inlet opening 32 of the nozzle housing 30 that is, on one side sealed by the bushing 52 and on the other side by the annular protrusion 26 of the nozzle 20. This cavity and the annular protrusion 26, as illustrated, can function as a moveable pneumatic piston in this cavity. The pneumatic circuit 84 ensures that a compressed gas, such as for example air, argon, nitrogen, helium, is present in this cavity at a predetermined pressure. An accumulator, as in the hydraulic system, is not required here as the compressed gas itself can be compressed.

Figure 7A:
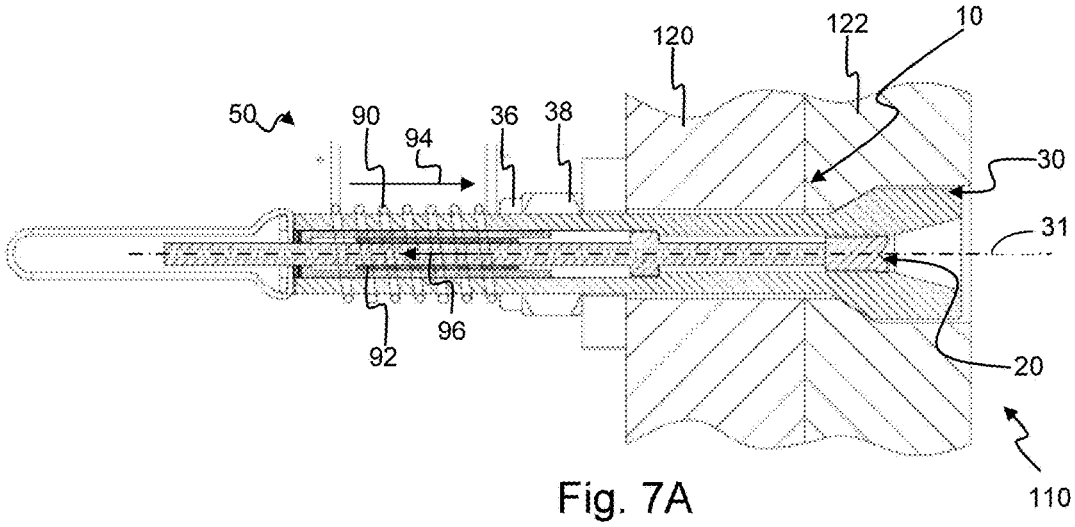
Figure 7B:
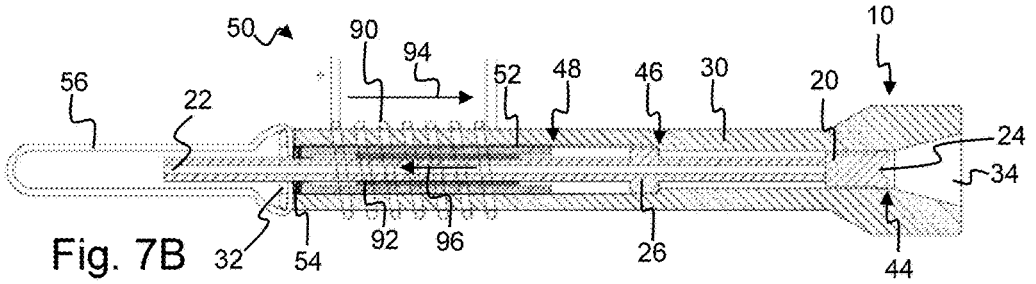
Figure 7C:
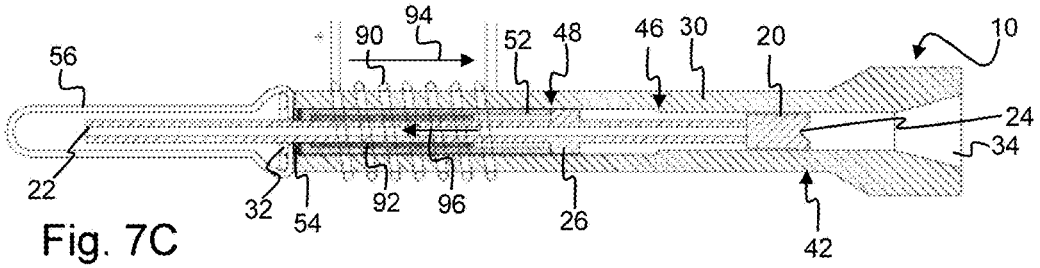

According to an alternative embodiment as illustrated in FIGS. 7A-C, equally similar to the embodiment illustrated in FIGS. 2A-2C, the elastic element 50 uses magnets. As is illustrated, the elastic element 50 comprises a first magnet 90, optionally produced as an electromagnet, mounted on the nozzle housing 30 and a second magnet 92, produced as a permanent magnet, mounted on the moveable nozzle 20. The magnetic field 94 of the first magnet 90 and the magnetic field 96 of the second magnet 92 have opposing fields whereby both magnets will repel each other and thus generate a magnetic force that is capable of keeping the nozzle 20 in the home position 44, as illustrated in FIG. 7B, and which enables the nozzle to move in the direction of the impact position 42 during an impact, as illustrated in FIG. 7C. According to an alternative embodiment the first magnet 90 can also be produced as a permanent magnet instead of an electromagnet.

As referred to above, the nozzle 20 can, particularly at the height of the discharge orifice 24, comprise a suitable nozzle that can achieve a suitable atomisation adapted to the dust that is to be combatted. The liquid that is atomised is generally on a water basis, and optionally provided with suitable additives to optimise the binding with the dust. Optionally, compressed air can also be added to the liquid, which enables a suitable atomisation at a lower fluid pressure.

According to an alternative embodiment of the invention, the nozzle 20 can, at the height of the discharge orifice 24, be provided with a reinforced impact element. This impact element would preferably be manufactured from a wear-proof material and can be produced as an isolated element or integrated in the nozzle. This impact element further reduces the risk of damage to the nozzle 20 as a result of an impact.

In order to provide one or more nozzle assemblies 10 according to the invention with a liquid at the desired flow rate and the desired pressure to enable an optimal dust-combatting, for example, there can be provided a pump unit with pumps, flow rate sensors and pressure sensors to supply the liquid from a reservoir or suitable fluid source, which means either fed under pressure or fed atmospherically, at the desired pressure and the desired flow rate. To achieve this it is preferable that a control unit is provided that processes the pump sensor readings and then controls the pumps as desired. This control unit can also make further additional functions possible, such as for example safety functions like a dry running protection that inhibits the pumps from being activated when insufficient fluid is present.

It is preferable that there is also provided a function whereby the nozzle assemblies 10 are rinsed with a fluid without additives during a rinsing cycle. This ensures that the additive remnants do not accumulate or crystallise and thus lead to blockages or reduce the efficient operation of the nozzle assembly 10. Furthermore in this regard, it is also beneficial to put the nozzle assemblies 10 through a rinsing cycle after completing an active labour cycle. This will inhibit material particles or dust particles from clogging at the level of the outlet opening 34 thus further reducing the risk of blockages. Furthermore, the control unit can be controlled in such a way that the flow rate of the liquid can be determined in relation to the load on the shredder 100 to arrive at an optimal operation with maximum dust-capturing and a minimum impact on the material's humidity levels.

Figure 8:
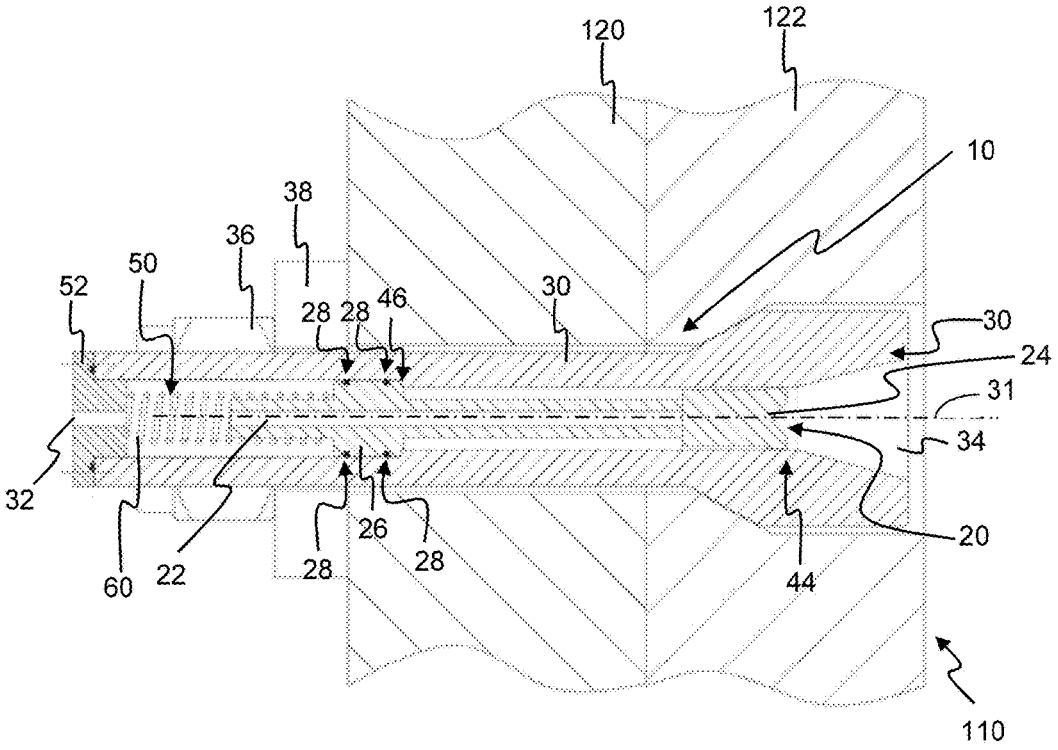
FIG. 8 shows still a further alternative embodiment of the nozzle.

FIG. 8 shows still a further embodiment similar to the embodiment illustrated in FIGS. 2A-C. As shown, also in this embodiment, the nozzle assembly 10 generally comprises a nozzle 20, nozzle housing 30 and an elastic element 50. Equally as with the embodiment of FIGS. 2A-C the nozzle housing 30 of the embodiment illustrated in FIG. 8 is produced as a bolt 30 with which the wear plate 122 is attached to the shredder housing 120. The bolt 30 is attached by way of a suitable nut 36 and a washer 38. The nozzle housing 30 comprises a central boring in alignment with the longitudinal axis 31 of the bolt 30. The nozzle 20 is mounted herein, as shown in FIG. 8. This nozzle 20 also comprises an intake orifice 22 for feeding the liquid on the one side and on the opposite side it comprises a discharge orifice 24 configured for atomising the liquid. Similarly also, the nozzle housing 30 comprises an inlet opening 32 on the side of the intake orifice 22 and an outlet opening 34 on the side of the discharge orifice 24. The outlet opening 34 is formed similarly as shown in FIGS. 2A-C. However, different from the embodiment of FIGS. 2A-C, the relative positioning of the inlet opening 32 of the nozzle housing 30 with respect to the intake orifice 22 of the nozzle 20 has changed. The intake orifice 22 is now positioned inside the boring that forms the cavity in which the annular protrusion 26 can move. The fluid is thus no longer provided directly to the intake orifice 22 but indirectly via the inlet opening 32 and the cavity formed in the nozzle housing 30. In order to prevent leakage of the fluid in between the annular protrusion 26 and the nozzle housing, preferably there is arranged a suitable sealing, such as for example suitable O-rings 28 as shown in FIG. 8. As shown the inlet opening 32 is formed in an alternative bushing 52, than that shown in the embodiment of FIGS. 2A-C. This bushing 52 is suitable fixed to the nozzle housing 30, for example by screwing or gluing it inside the bore hole forming the cavity in which the annular protrusion 26 of the nozzle 20 moves.

It is clear that similar as in the embodiment of FIGS. 2A-C the spring 60 which is arranged between the bushing 52 and the annular protrusion 26 of the nozzle 20 allows for an elastic element 50 with a comparable functionality. This means that the nozzle 20 is moveably mounted in the nozzle housing 30 and that the nozzle 20 can move in alignment with the longitudinal axis 31 between an impact position and a home position, illustrated in FIG. 8. The annular protrusion 26 forms, as illustrated, a seat for one end of the spring 60, while the bushing 52 forms a seat for the other end of the spring 60. The distance between both seats for the spring 60 is chosen in such a way that in the home position, illustrated in FIG. 8, the spring 60 has already been compressed and as such exerts a certain resistance whereby the nozzle 20 is pressed against the stop 46 in an unloaded rest condition in which the nozzle is not subjected to an impact and as such is held in the home position. Similar as explained with reference to the embodiment of FIGS. 2A-C, as a result of the force or load of an impact the nozzle 20 temporarily moves in the direction of an impact position. An impact as a result of material particles that are thrown around by the cutting drum 106 in the shredder zone 110 causes a force on the side of the outlet orifice 24 of the nozzle 20 and the component of this force, in alignment with the longitudinal direction 31, will push the nozzle 20 in the direction of the outlet 34 of the nozzle housing 30. This causes the annular protrusion 26 to to compress the spring 60. The spring 60 will maximally be compressed until the intake orifice 22 reaches the bushing 52 which will thus form a stop for the nozzle 20 that determines the maximum displacement of the nozzle 20 in the direction of the outlet orifice 34, also referred to as the impact position. After the impact event the spring 60 will move the nozzle 20 back to its home position.

It is clear that in the preferred embodiment of FIGS. 2A-C, the intake orifice 22 protrudes beyond the inlet opening 32 of the nozzle housing 30. This means that this intake orifice 22 is available at the outside of the shredder housing 120 for a direct coupling to for example a flexible conduit supplying the fluid to be atomised. All fluid is contained within the nozzle 20 itself and no fluid is contacting the nozzle housing 30, thereby eliminating the need for any form of sealing between the movable nozzle 20 and the nozzle housing 30. This is advantageous as such a sealing is subjected to wear during frequent movement of the nozzle 20 with respect to the nozzle housing 30. It is also clear that according to the embodiment of FIG. 8, the inlet opening 32 of the nozzle housing provides a stationary element for providing the supply of fluid to be atomised. This can be advantageous as it reduces the wear flexible conduits might be subjected to during frequent movement of the movable nozzle 20 and allows for the use of static elements such as for example conduits formed by suitable piping for supplying fluid to the nozzle assembly 10.

It is clear that countless further alternative embodiments are possible without diverging from the scope of the protection of the invention as defined in the claims.

The invention claimed is:

1. A method of operating a shredder, the shredder comprising a cutting drum and a shredder housing, the shredder housing comprising one or more nozzle assemblies mounted in a working zone of the cutting drum, the one or more nozzle assemblies each configured to atomise a liquid for preventing dust formation in the working zone of the cutting drum and the one or more nozzle assemblies each comprising:

a nozzle with an intake orifice configured to receive the liquid, and a discharge orifice configured to atomise the liquid; and a nozzle housing in which the nozzle is mounted and comprising an inlet opening on the side of the intake orifice and an outlet opening on the side of the discharge orifice, the nozzle moveably mounted in the nozzle housing such that the nozzle is moveable between an impact position and a home position;

the one or more nozzle assemblies further comprising an elastic element mounted to work in conjunction with the nozzle and the nozzle housing such that the nozzle is held in the home position in an unloaded rest condition in which the nozzle is not subjected to an impact, and as a result of the force of an impact temporarily moves in the direction of the impact position; the method comprising:

operating the one or more nozzle assemblies in an active cycle, and operating the one or more nozzle assemblies in a rinsing cycle, wherein the one or more nozzle assemblies are rinsed with a fluid without additives during the rinsing cycle;

wherein the flow rate of the liquid used in the active cycle and the fluid without additives used in the rinsing cycle is determined in relation to a load on the shredder.

2. A method according to claim 1, wherein the outlet opening of the nozzle housing extends further towards the working zone of the cutting drum than the discharge orifice of the nozzle.

3. A method according to claim 2, wherein the outlet opening of the nozzle housing is provided with a slightly conical form that opens in the direction of the working zone.

4. A method according to claim 2, wherein the home position is positioned such that the nozzle, at the side of the discharge orifice, does not protrude or project from the shredder housing when positioned in the home position.

5. A method according to claim 1, wherein the home position is positioned closer to the cutting drum than the impact position, and is positioned such that the nozzle at the side of the discharge orifice does not protrude from the shredder housing when positioned in the home position.

6. A method according to claim 1, wherein the nozzle housing comprises a first stop against which the nozzle is pressed by the elastic element to hold the nozzle in the home position.

7. A method according to claim 1, wherein the nozzle housing comprises a second stop against which the nozzle is pressed in the impact position as a result of the force of an impact.

8. A method according to claim 1, wherein the elastic element comprises a spring.

9. A method according to claim 1, wherein the elastic element comprises an elastic bushing.

10. A method according to claim 1, wherein the elastic element comprises a hydraulic circuit with an accumulator or that the elastic element comprises a pneumatic circuit.

11. A method according to claim 1, wherein the liquid to be atomised is combined with a gas.

12. A method according to claim 1, wherein the elastic element comprises a first magnet mounted on the nozzle housing and comprises a second magnet mounted on the nozzle, the first magnet and second magnet comprising an opposing magnetic field.

13. A method according to claim 1, wherein the one or more nozzle assemblies comprises non-magnetic materials.

14. A method according to claim 1, wherein the nozzle housing is produced as a mounting element for the shredder.

15. A method according to claim 1, wherein the shredder housing is lined with one or more wear plates and the one or more nozzle assemblies are configured as mounting elements for these one or more of wear plates.

16. A method according to claim 1, wherein the discharge orifice is configured to atomise the liquid with a droplet size of less than 2 mm.

* * * * *